United States Patent [19]

Sassak

[11] Patent Number: 4,725,256

[45] Date of Patent: Feb. 16, 1988

[54] PNEUMATIC CONSTRUCTION GAME

[76] Inventor: John J. Sassak, 36855 Schoolcraft, Livonia, Mich. 48150

[21] Appl. No.: 867,073

[22] Filed: May 27, 1986

[51] Int. Cl.[4] ..... A63H 18/00; B65G 51/16

[52] U.S. Cl. ..... 446/176; 273/86 D; 446/132; 446/179

[58] Field of Search ..... 446/132, 176, 178, 179; 273/86 D

[56] References Cited

U.S. PATENT DOCUMENTS

| | | | |
|---|---|---|---|
| 417,931 | 12/1889 | Miatt | 446/132 X |
| 2,890,537 | 6/1959 | Benko | 446/178 X |
| 3,469,340 | 9/1969 | Breneman et al. | 273/86 D |
| 3,643,953 | 2/1972 | Fixler | 273/119 B |
| 3,697,071 | 10/1972 | Anderson | 273/86 D |

FOREIGN PATENT DOCUMENTS

| | | | |
|---|---|---|---|
| 2043472 | 10/1980 | United Kingdom | 273/86 D |

*Primary Examiner*—Kenneth J. Dorner
*Assistant Examiner*—Peter R. Brown
*Attorney, Agent, or Firm*—Charles W. Chandler

[57] ABSTRACT

A pneumatic construction game comprising a series of connected plastic tubes forming an endless conduit having an inlet opening, a source for delivering pressurized air into the conduit, a body movable in the conduit in response to introduction of the pressurized air, and control vents, upstream and downstream of the inlet opening, to control the motion of the body as it moves around the conduit.

11 Claims, 11 Drawing Figures

PNEUMATIC CONSTRUCTION GAME

BACKGROUND OF THE INVENTION

This invention is related to a pneumatic construction game, and more particularly to an easily assembled, tubular construction game having pressurized air for moving a body around an endless conduit, with adjustable air vents in the conduit for controlling the rate of motion of the body.

Pneumatic amusement games are known in the prior art in which pressurized air is employed to move a lightweight body along an open-ended tube. See for example, U.S. Pat. No. 4,250,657 which issued to Gordon A. Barlow, et al, Feb. 17, 1981. When the ends of the tube are connected together, it is difficult to control the motion of the ball along the tube.

SUMMARY OF THE INVENTION

The broad purpose of the present invention is to provide a pneumatic construction game formed of a series of transparent plastic tubes connected together by plastic joints to form an endless conduit. The conduit can be formed in a variety of configurations having both horizontal and vertical courses. A lightweight body is inserted in the conduit. A source of pressurized air, which may be a common hair dryer, moves the body along the conduit. Vent openings, both upstream and downstream of the air source, are adjusted by solenoid actuated air valves to change the pressure levels in the conduit and thereby influence the motion of the body around the conduit.

In another embodiment of the invention, a metalized body is moved along the conduit. A magnet, mounted adjacent the conduit, is employed for stopping or controlling the motion of the metalized body.

Still further objects and advantages of the invention will become readily apparent to those skilled in the art to which the invention pertains upon reference to the following detailed description.

DESCRIPTiON OF THE DRAWINGS

The description refers to the accompanying drawings in which like reference characters refer to like parts throughout the several views, and in which.

DESCRIPTION OF THE PREFERRED EMBODIMENT

Figure 1:
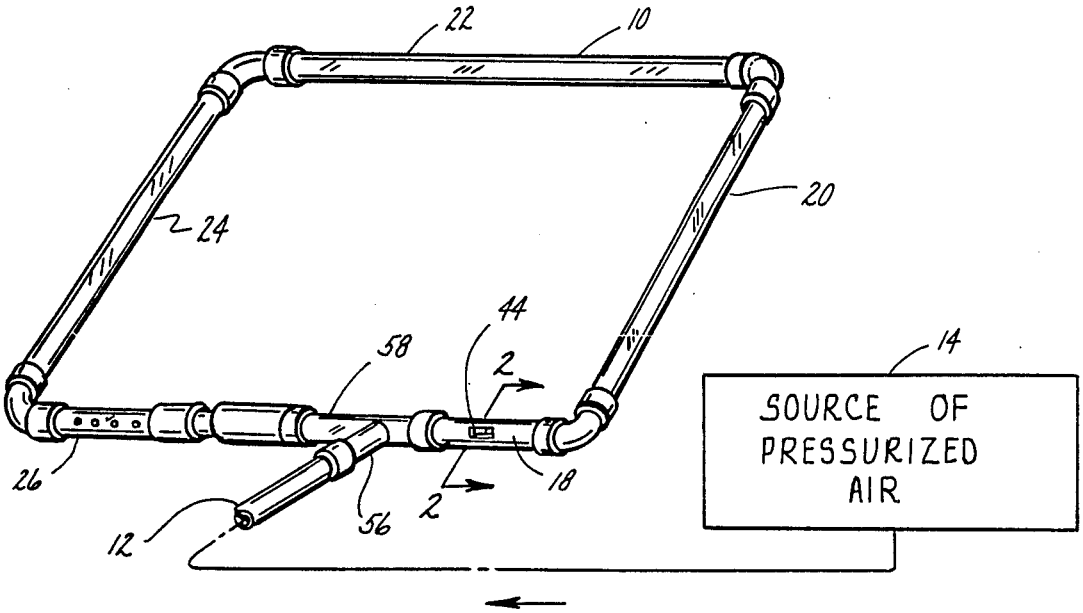
FIG. 1 is a partially schematic view of a tubular conduit embodying the invention.
Figure 3:
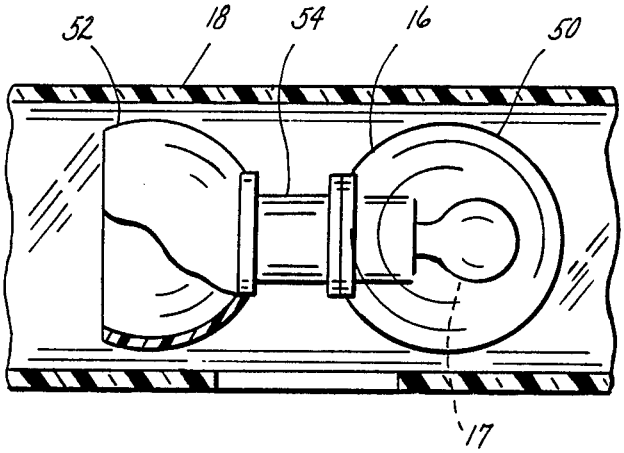
FIG. 3 is a view at right angles with respect to FIG. 2, showing another view of the body.

Referring to the drawings, FIG. 1 illustrates a tubular conduit 10 having an inlet tube 12 connected to a source of pressurized air 14. Source 14 may comprise a relatively low pressure source of air, such as a hair dryer, for providing a propelling force for body 16, illustrated in FIG. 3. Body 16 has an internally mounted, electrically-energized light means 17.

Conduit 10 comprises a series of transparent, plastic tubes 18, 20, 22, 24, and 26 connected by similarly shaped, right-angle tubular joints 28, 30, 32, and 34 such that the conduit has a generally uniform cross-section along its length. The collective length of the assembled conduit is commensurate with the pressurized air available from source 14.

Figure 6:
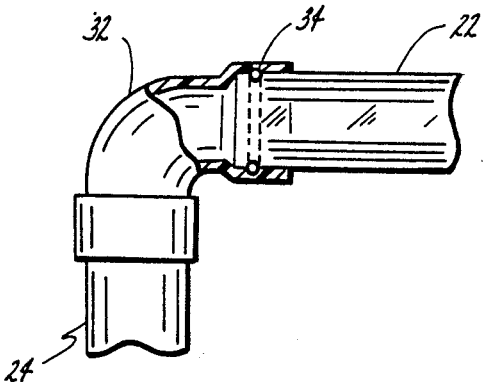
FIG. 6 is a view showing a pair of tubular elements connected to a typical joint.

FIG. 6 illustrates a pair of typical tubes 22 and 24, having their ends received in joint 32. O-rings 34 provide an airtight seal between the joint and each tube.

Figure 4:
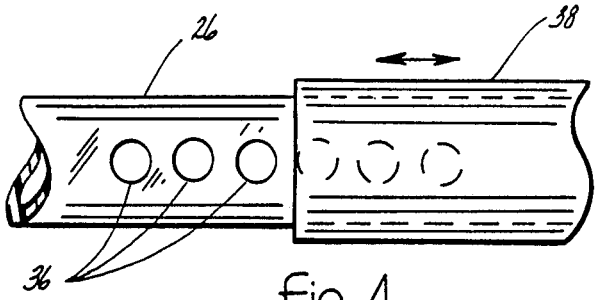
FIG. 4 is a view showing the adjusting sleeve for opening and closing the upstream vent openings.
Figure 5:
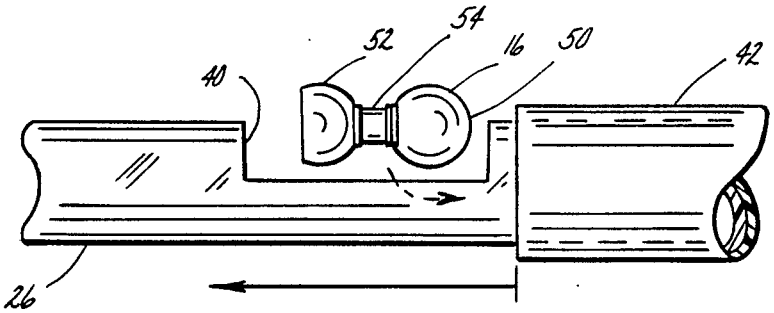
FIG. 5 illustrates an opening for removing or inserting the body into the conduit.

Referring to FIGS. 1 and 4, tube 26 has a series of longitudinally spaced vent openings 36 upstream of inlet tube 12. Sleeve 38 is slideably mounted on tube 26 to either block or open selected openings 36 to control the rate of air flow through the vent openings.

Tube 26 also has a larger opening 40, having a length and width sufficient to either remove or insert body 16 into the conduit. A second sleeve 42 is slideably movable along tube 26 to either close or open opening 40.

Figure 2:
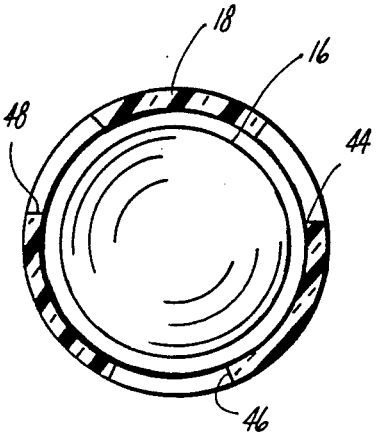
FIG. 2 is a cross-section showing the body within the conduit adjacent the downstream vent openings.

Referring to FIGS. 1 and 2, tube 18 has three similarly-shaped vent openings 44, 46 and 48 for passing air. Vent openings 44, 46 and 48 are disposed around tube 18, downstream of inlet tube 12.

Body 16 comprises a hollow, spherical element 50 and a hollow, semi-spherical element 52, connected together by rigid connector means 54. Elements 50 and 52 have a diameter slightly less than the internal diameter of the conduit so that the body can pass around the conduit.

Figure 7:
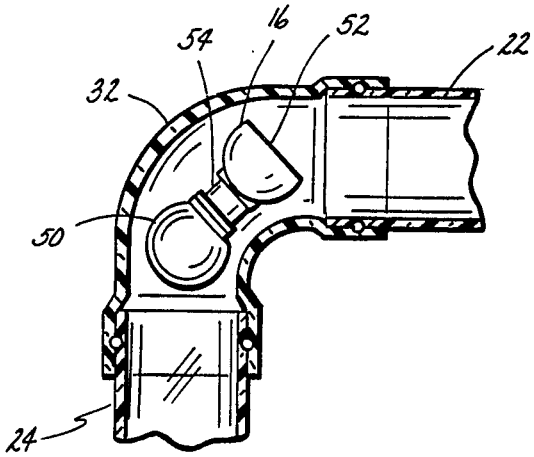
FIG. 7 is a view showing the body moving around a right angle joint.
Figure 8:
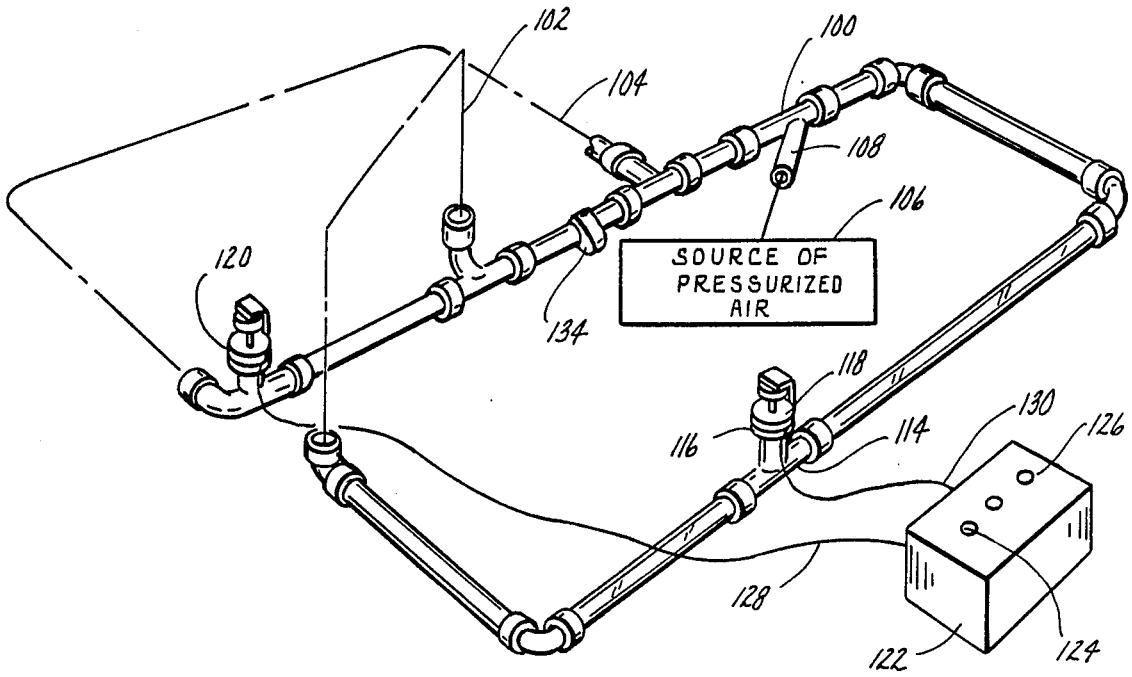
FIG. 8 is a partially-schematic view of another embodiment of the invention.

FIG. 7 illustrates the manner in which body 16 passes around joint 32.

Referring to FIG. 1, joint 56 preferably comprises an in-line tubular section 58 which receives tubes 18 and 26, and inlet tube 12 having an inlet opening. Inlet tube 12 is a linear section disposed at an angle of about 45 degrees with respect to the longitudinal axis of tubes 18 and 26 for delivering pressurized air at an angle with respect to the direction of movement of the body as it passes the inlet opening, from left to right, as viewed in FIG. 1.

Vent openings 36, upstream of the inlet opening, and vent openings 44, 46 and 48 downstream of the inlet opening, provide a sufficient discharge of the pressurized air from the conduit so that the body readily travels around the conduit. The velocity of the body is adjusted by opening or closing selected vent openings 36.

Figure 9:
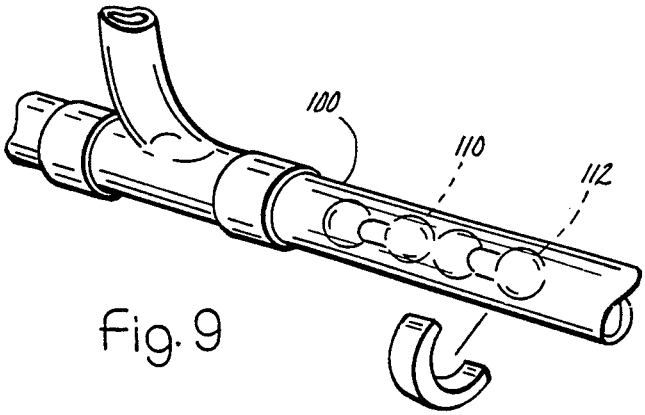
FIG. 9 is a fragmentary view, showing a magnet employed for stopping the motion of a body.

FIGS. 8, 9, 10 and 11 illustrate another embodiment of the invention comprising a tubular conduit 100 having a vertical course 102 and a horizontal course 104. A source of pressurized air 106 is connected to inlet tube 108 to provide a propelling force for a plurality of bodies 110 and 112, as best illustrated in FIG. 9.

Conduit 100 has a hollow joint 114 with inlet opening 116 for receiving body 110. The conduit also has a second opening 116. Both openings 114 and 116 are varied in size by solenoid-actuated air valves 118 and 120, respectfully, to regulate the velocity of the bodies around the circuit. Control box 122 has a pair of control buttons 124 and 126 electrically connected by conductors 128 and 140 to valves 120 and 118, respectively, for selectively opening and closing the air valves. The air valves vary the vent openings and thereby adjust the air pressure in the conduit to control the motion of the bodies along the conduit. Several vent openings, each with an air valve, can be inserted along the conduit.

Figure 10:
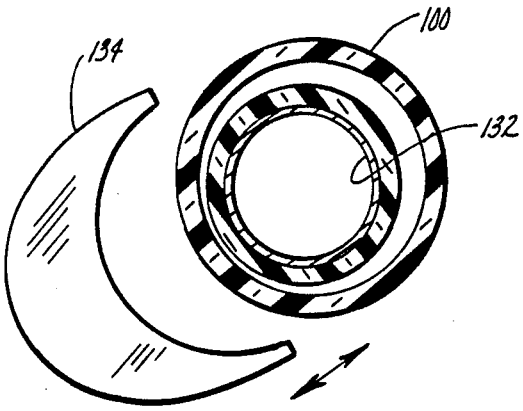
FIG. 10 is a view generally at right angles to FIG. 9, through the metalized bodys.
Figure 11:
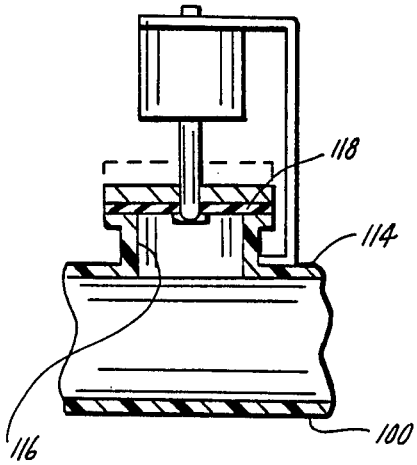
FIG. 11 is a sectional view through a typical vent opening.

Body 112, illustrated in section in FIG. 10, has a metalized coating 132 on its interior surface so that it is magnetically attractive.

A permanent magnet 134 is mounted adjacent the conduit so as to be movable, either toward or away from the conduit, depending upon whether the user desires to magnetically attract body 112 as it passes the magnet. If the user moves magnet 134 closely adjacent the conduit, the magnet will attract and hold body 112 thereby terminating its motion. Body 112 will in turn cause the other bodies, as they move up behind body 112, to either stop their motion or rebound such that they proceed up vertical course 102. Moving magnet 134 away from the conduit magnetically releases body 112 so that the pressurized air causes it to move forward around the conduit.

Having described my invention, I claim:

1. A pneumatic construction game apparatus, comprising: tube means forming an endless, elongated conduit;

a body disposed in the conduit, the body being movable in the conduit along a predetermined path of motion defined by the conduit in a first direction in response to a fluid pressure differential on opposite sides of the body;

the conduit having a first inlet opening for receiving air under pressure, and means connected thereto for delivering air under pressure into the conduit for moving the body along said predetermined path of motion;

the conduit having a first vent opening adjacent the path of motion of the body for discharging pressurized air received through said inlet opening, but permitting the body to remain in the conduit;

the conduit having a second vent opening adjacent the path of motion of the body for discharging pressurized air received through said inlet opening, but permitting the body to remain in the conduit, and means for adjusting the second vent opening so as to adjust the rate of flow of air being discharged therethrough;

means connected to the first inlet opening for providing a source of pressurized air into said conduit;

whereby the air delivered under pressure through the first inlet opening is operable to move the body along said path of motion at a velocity and direction depending upon air being discharged through the second vent opening.

2. A combination as defined in claim 1, in which the body is moved in the conduit in said first direction with respect to the first inlet opening, and the air is delivered into the conduit at an acute angle with respect to the direction of motion of the body in the conduit.

3. A combination as defined in claim 1, in which the body is moved in the conduit in said first direction with respect to the inlet opening, and air is delivered at an angle of about 45 degrees with respect to said first direction.

4. A combination as defined in claim 1, in which the body comprises a pair of spaced, generally hollow members, and means connecting the hollow members together, such that one is disposed behind the other as the two hollow members are moved along the conduit.

5. A combination as defined in claim 4, in which the means connecting the two hollow members together is a relatively rigid element.

6. A combination as defined in claim 1, including means forming a third opening in the conduit for removing the body from the conduit.

7. A combination as defined in claim 1, in which the tube means comprises a plurality of tubular elements, and joint members connecting the tubular elements together.

8. A combination as defined in claim 1, in which the means for providing the source of pressurized air comprises a hair dryer.

9. A combination as defined in claim 1, in which the body has magnetically-attractive means, and including a magnet mounted adjacent the conduit so as to be movable toward the conduit to a first position in which it magnetically attracts the body to stop its motion, and a release position in which the magnet is moved away from the conduit to release the body for motion in response to the pressurized air.

10. A combination as defined in claim 1, in which said adjusting means comprises a first solenoid-actuated air valve for varying the second vent opening and thereby the air pressure influencing the movement of the body along said path of motion.

11. A combination as defined in claim 10, including a second solenoid-actuated air valve for adjusting the rate of air being discharged through the first vent opening, and actuator means remotely and electrically connected to said first solenoid-actuated air valve and said second solenoid-actuated air valve for independently adjusting the air flow rate being discharged through said first and second vent openings.

* * * * *